United States Patent [19]

Ware, III et al.

[11] Patent Number: 4,544,350

[45] Date of Patent: Oct. 1, 1985

[54] BURNER APPARATUS FOR SIMULTANEOUSLY INCINERATING LIQUID, DRY GAS AND WET GAS STREAMS

[75] Inventors: Joseph W. Ware, III, Lake Charles; James A. DeBernardi, Sulphur; James R. Holcomb, Lake Charles, all of La.

[73] Assignee: Vista Chemical Company, Houston, Tex.

[21] Appl. No.: 437,002

[22] Filed: Oct. 27, 1982

[51] Int. Cl.[4] ..... F24C 3/00; C01B 7/18

[52] U.S. Cl. ..... 431/285; 431/207; 431/5; 431/11; 423/481; 423/210; 570/222

[58] Field of Search ..... 431/284, 285, 278, 5, 431/11, 252, 242, 219, 210, 215, 202; 239/422, 425; 570/219, 222; 423/210 C, 481

[56] References Cited

U.S. PATENT DOCUMENTS

| | | | |
|---|---|---|---|
| 230,748 | 8/1880 | Coventry et al. | 431/207 |
| 1,520,624 | 12/1924 | Wiederwax | 431/11 |
| 1,929,675 | 10/1933 | Chappell et al. | 423/210 C |
| 2,395,276 | 2/1946 | Jordan | 431/278 X |
| 2,982,348 | 5/1961 | Samothrakis | 431/207 X |
| 3,074,361 | 1/1963 | Huge et al. | 431/284 |
| 3,134,424 | 5/1964 | Zink et al. | 431/202 |
| 3,273,621 | 9/1966 | Childree | 431/284 X |
| 3,273,627 | 9/1966 | Zink et al. | 431/202 |
| 3,561,895 | 2/1971 | Michelson | 431/11 |
| 3,614,282 | 10/1971 | Gabor | 431/11 X |
| 3,729,285 | 4/1973 | Schwedersky | 431/284 X |
| 3,897,200 | 7/1975 | Childree | 431/285 X |
| 4,018,879 | 4/1977 | Winnen | 423/240 R |
| 4,033,725 | 7/1977 | Reed et al. | 431/5 X |
| 4,070,146 | 1/1978 | Straitz, III | 431/202 |
| 4,073,871 | 2/1978 | Optiz et al. | 431/5 X |
| 4,137,036 | 1/1979 | Straitz, III | 431/202 |
| 4,140,473 | 2/1979 | Hoehing et al. | 431/11 |
| 4,148,599 | 4/1979 | Reed et al. | 431/11 |
| 4,174,201 | 11/1979 | Straitz, III | 431/202 |
| 4,198,384 | 4/1980 | Robinson | 423/481 |
| 4,255,359 | 3/1981 | Brunelle | 423/481 X |
| 4,347,652 | 8/1982 | Reed et al. | 431/188 |
| 4,351,819 | 9/1982 | Riegel et al. | 570/243 X |
| 4,392,817 | 7/1983 | Berlie et al. | 431/5 X |
| 4,428,727 | 1/1984 | Deussner et al. | 431/284 X |

*Primary Examiner*—Samuel Scott
*Assistant Examiner*—Carl D. Price
*Attorney, Agent, or Firm*—Browning, Bushman, Zamecki & Anderson

[57] ABSTRACT

An improved method and burner apparatus for simultaneously incinerating liquid, dry gas and wet gas streams such as the vent streams in a chemical plant or the like are provided. The method comprises combining the dry gas and wet gas streams, heating the resultant combined stream to thereby prevent condensation from occurring, flowing the heated combined stream through a gas distributing nozzle means, flowing the liquid stream through a liquid atomizing and atomized liquid distributing nozzle means positioned adjacent the gas distributing nozzle means, mixing air with the gas and atomized liquid distributed by the nozzle means, and igniting and combusting the resulting air-gas-atomized liquid mixture. Burner apparatus for carrying out the method is also provided.

7 Claims, 3 Drawing Figures

BURNER APPARATUS FOR SIMULTANEOUSLY INCINERATING LIQUID, DRY GAS AND WET GAS STREAMS

BACKGROUND OF THE INVENTION

1. Field of the Invention

The present invention relates generally to an improved method and burner apparatus for simultaneously incinerating liquid, dry gas and wet gas streams, and more particularly, but not by way of limitation, to a method and burner apparatus for simultaneously incinerating liquid, dry gas and wet gas waste streams wherein the heat generated and combustion products formed from the incineration are utilized to generate steam, produce electrical energy, produce additional products, etc.

2. Description of the Prior Art

In chemical processes, liquid and/or gas byproducts and/or vent streams are often produced which cannot be reutilized and must be disposed of. Heretofore, a common way of disposing of such byproduct and vent streams has been to incinerate the streams, particularly where the substances making up the stream are at least to some extent combustible. Flare stacks and special flare burners have been utilized, but when flare stacks are used the combustion products and heat generated by the incineration are introduced into the atmosphere and wasted. More recently, burner apparatus for incinerating such byproduct and/or vent streams have been developed which are utilized with furnaces to heat process streams, to generate steam which is in turn utilized in a process or to produce electricity or otherwise to utilize the heat generated whereby it is not wasted.

Typically, the waste streams produced in chemical processes include liquid streams, dry gas streams (gas containing little or no water vapor) and wet gas streams (gas containing or saturated with water vapor). While burner apparatus for simultaneously incinerating such liquid, dry gas and wet gas streams have been developed heretofore, such burner apparatus have included separate burner means for the various streams and have been found to be relatively inefficient and mechanically unreliable, i.e., frequent replacement of parts is required due to corrosion and/or overheating failures.

By the present invention, an improved method and burner apparatus are provided for simultaneously incinerating liquid, dry gas and wet gas streams which bring about the efficient incineration of the streams in a manner whereby the heat generated from the incineration as well as the combustion products formed can be utilized effectively. The burner apparatus has improved reliability in that less frequent maintenance due to heat and corrosion failure is required.

SUMMARY OF THE INVENTION

An improved method of simultaneously incinerating liquid, dry gas and wet gas streams comprising combining the dry gas and wet gas streams, heating the resultant combined stream to thereby prevent condensation from occurring, flowing the heated combined stream through a gas distributing nozzle means, flowing the liquid stream through at least one liquid atomizing and distributing nozzle means positioned adjacent the gas distributing nozzle means, mixing air with the gas and atomized liquid distributed by the nozzle means, and igniting and combusting the resulting air-gas-atomized liquid mixture. Apparatus for carrying out the method of the invention is also provided.

It is, therefore, a general object of the present invention to provide a method and burner apparatus for simultaneously incinerating liquid, dry gas and wet gas streams.

A further object of the present invention is the provision of an improved burner apparatus for simultaneously incinerating a plurality of waste gas streams, both in the liquid and gaseous states wherein at least one of such streams contains water or is water saturated.

Another object of the present invention is the provision of a method and burner apparatus wherein liquid, dry gas and wet gas streams are simultaneously efficiently incinerated, the heat generated and combustion products formed utilizable and maintenance of the apparatus is reduced to a minimum.

Other and further objects, features and advantages of the present invention will be readily apparent to those skilled in the art upon a reading of the description of the preferred embodiments which follows when taken in conjunction with the accompanying drawings.

DESCRIPTION OF PREFERRED EMBODIMENTS

Figure 2:
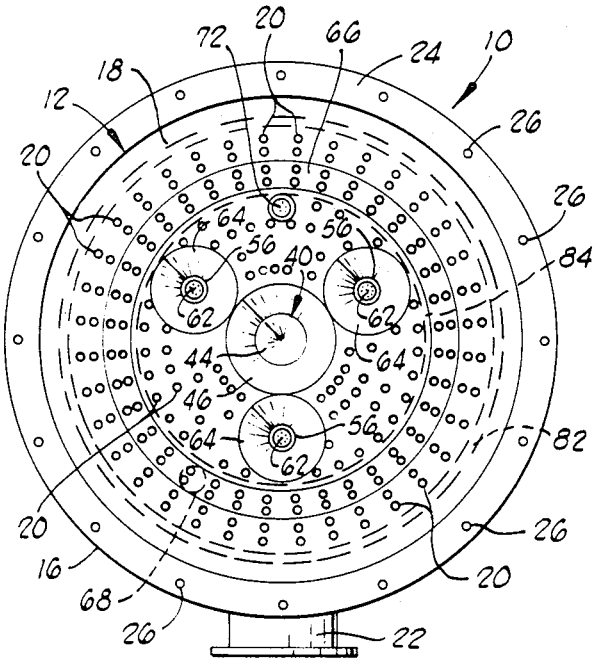
FIG. 2 is an end view taken along line 2—2 of FIG. 1.
Figure 3:
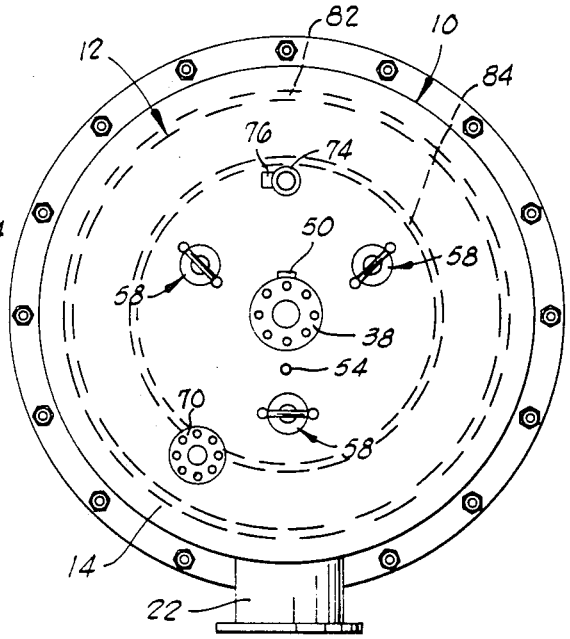
FIG. 3 is an end view taken along line 3—3 of FIG. 1.

Referring now to the drawings, the improved burner apparatus of the present invention is illustrated and generally designated by the numeral 10. The apparatus 10 is comprised of a cylindrical metal housing 12 which includes a back wall 14, sides 16 and a front firing wall 18. The back wall 14 and sides 16 are solid, but as shown in FIG. 2 the front firing wall includes a plurality of air passages 20 disposed in spaced relationship over portions of the surface thereof.

The housing 12 defines an air plenum, and an air inlet connection 22 is attached to the housing 12 at a convenient location, such as in a side 16 thereof. The sides 16 extend beyond the firing wall 18 a short distance and include an outwardly extending flange 24 attached thereto. The flange 24 includes a plurality of openings 26 disposed therein in spaced relationship. The flange 24 and openings 26 engage and align with a complementary flange 28 which is connected to a furnace 30. A plurality of studs and nuts 32 and 34, respectively, maintain the flanges 24 and 28 in rigid sealed engagement.

A centrally positioned elongated gas burner tube 36 is sealingly connected through the back wall 14 and extends longitudinally through the interior of the housing 12 and through the firing wall 18. The rearward end of the tube 36 has a flange connection 38 attached thereto and the forward end of the tube 36 extending through and past the firing wall 18 terminates in a gas burner nozzle, generally designated by the numeral 40. The gas burner nozzle 40 can take various forms, but in the form illustrated, the end portion of the tube 36 includes a plurality of substantially rectangular shaped openings 42 formed therein and the end of the tube 36 is closed by a cap 44 of inverted conical shape. A circular central portion 46 of the firing wall 18 through which the forward end portion of the gas burner tube 36 extends is indented in a truncated conical shape corresponding with the shape of the cap 44. The indented portion 46 of the firing wall 18 does not include air passages 20, as shown in FIG. 2.

Disposed around the exterior surfaces of the gas burner tube 36 and sealingly attached thereto is a steam jacket 48. The steam jacket 48 includes a steam inlet connection 50 and a steam and/or condensate outlet connection 52 connected thereto. A conduit 54 which sealingly extends through the back wall 14 is connected to the outlet connection 52.

Figure 1:
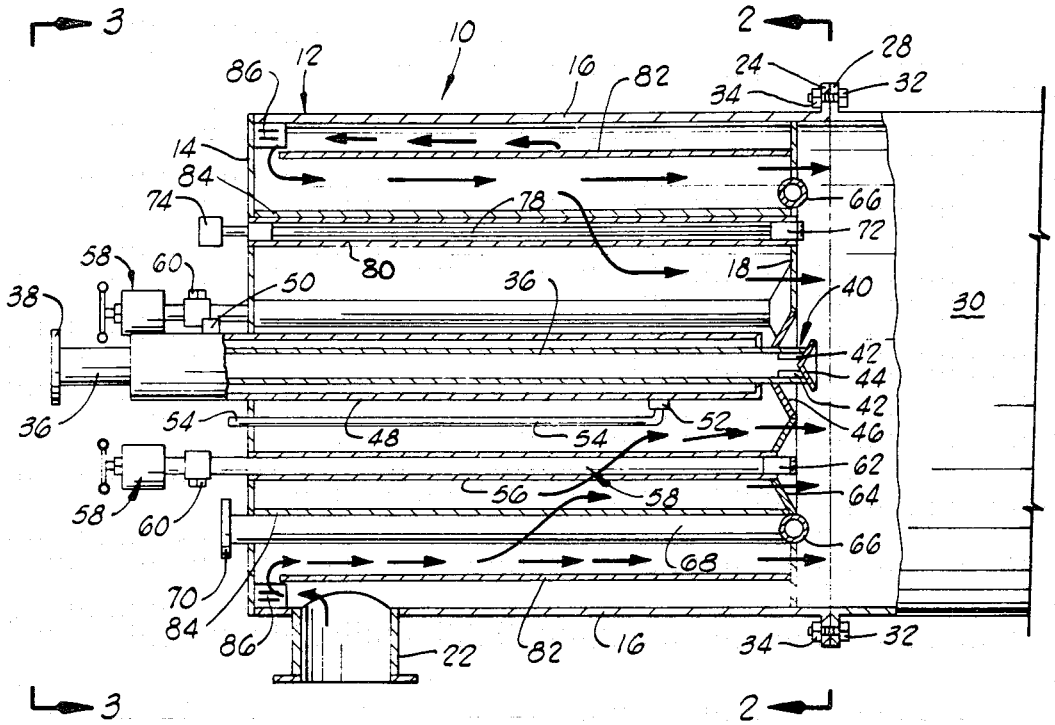
FIG. 1 is a side cross-sectional view of the improved burner apparatus of the present invention.

Three elongated liquid burner tubes 56 are spaced around the centrally positioned gas burner tube 36 and are sealingly connected through the back wall 14. The liquid burner tubes 56 extend longitudinally through the housing 12 and through the firing wall 18. Each of the liquid burner tubes 56 has a conventional liquid burner gun 58 disposed therein which includes an inlet connection 60 at the rearward end and a distributing nozzle 62 at the forward end thereof. As is well understood by those skilled in the art, steam is combined with the liquid flowing through the burner guns 58 and the guns function to atomize the liquid and distribute it by way of the nozzle 62. As shown in FIGS. 1 and 2, circular portions 64 around each of the liquid burner tubes 56 do not include the air passages 20 and are indented in the same manner as the circular portion 46 around the gas burner tube nozzle 40.

Positioned around the gas burner tube nozzle 40 and the liquid burner gun nozzles 62 is a fuel gas burner ring 66. The burner ring 66 is attached to the firing wall 18 and a conduit 68 is connected to the ring 66 and extends through the housing 12 and sealingly through the back wall 14 thereof for conducting fuel gas to the burner ring 66. An inlet flange 70 is connected to the rearward end of the conduit 68.

A pilot light burner nozzle 72 is positioned adjacent the burner ring 66 and is connected to an air-fuel mixer 74 and fuel inlet connection 76 by a conduit 78. The conduit 78 and nozzle 72 are disposed in a pilot tube 80 which extends through an between the back wall 14 and firing wall 18.

The air plenum defined by the housing 12 is divided into primary, secondary and tertiary subplenums by a pair of continuous, preferably cylindrical baffles 82 and 84 which extend longitudinally within the housing, one inside the other. The baffle 82 is solid (does not contain air passages, slots, etc.) and is sealingly attached to the firing wall 18 at its forward end. The rearward end of the baffle 82 is sealingly attached to a preferably cylindrical adjustable air louver 86 which is in turn sealingly attached to sides 16 and/or back wall 14 of the housing 12. The baffle 84 is attached at its forward end to the firing wall 18 between the burner ring 66 and the liquid burner tubes 56 and gas burner tube 36 and at its rearward end to the back wall 14. The baffle 84 includes a predetermined number and size of slots or openings disposed therein to limit the flow of air therethrough. Thus, a primary air plenum is defined by and between the sides 16 of the housing 12 and the baffle 82, a secondary plenum is defined by and between the baffle 82 and the baffle 84 and a tertiary plenum is defined by and within the baffle 84. The air passages 20 disposed in the firing wall 18 are positioned therein (FIG. 2) whereby air flows therethrough only from the secondary and tertiary plenums defined by the baffles 82 and 84 and not from the primary plenum as shown by the arrows on FIG. 1.

In carrying out the method of the present invention wherein liquid, dry gas and wet gas streams are simultaneously incinerated and the heat generated as well as the combustion products formed utilized beneficially, the burner apparatus 10 can be connected to a furnace 30 as illustrated in FIG. 1 or to other apparatus wherein heat and combustion products are utilized. A source of fuel gas, such as methane, is connected by conduits (not shown) to the flange connection 70 of the conduit 68 and to the connection 76 of the air-fuel mixer 74 which is in turn connected to the pilot burner 72 by the conduit 78. The liquid stream or streams to be incinerated are connected by one or more conduits (not shown) to the inlet connections 60 of the liquid burner guns 58. The dry gas stream or streams are combined with the wet gas stream or streams and the resulting combined stream is conducted by a conduit (not shown) to the inlet connection 38 of the gas burner tube 36. Steam is conducted from a source thereof by a conduit (not shown) to the inlet connection 50 of the steam jacket 48 as well as to the nozzles 62 (connections not shown) of the liquid burner guns 58 and steam and condensate are withdrawn from the jacket 48 by way of the connection 52 and conduit 54. A source of pressurized air, such as an air blower, is connected by a conduit (not shown) to the air inlet connection 22 of the housing 12.

The fuel gas flowing to the air-fuel mixer 74 is combined with air and the combined stream flows by way of the conduit 78 to the burner nozzle 72. The air-fuel mixture distributed from the nozzle 72 is burned to produce a pilot flame for lighting the fuel gas distributed by the burner ring 66. That is, fuel gas flowing to the burner ring 66 by way of the conduit 68 connected thereto is distributed from the burner ring 66 and is mixed with air flowing past the burner ring 66 by way of the air passages 20 in the firing wall 18 which are communicated with the secondary plenum within the housing 12 defined by and between the baffles 82 and 84. The resulting air-fuel mixture is ignited by the pilot flame from the burner nozzle 72 and combusted. Pressurized air flows into the interior of the housing 12 by way of the connection 22, through the primary plenum defined by and between the sides 16 and baffle 82, through the adjustable louvers 86 and into the secondary plenum defined by and between the baffles 82 and 84. A portion of the air flows through the passages 20 communicating with the secondary plenum while another portion flows through the pressurized openings or slots in the baffle 84 into the tertiary plenum and then through the passages 20 communicated with the tertiary plenum. The air flow described above is shown by the arrows on FIG. 1.

The combined stream of wet and dry gas flows through the gas burner tube 36 wherein it is heated by steam flowing through the steam jacket 48 connected thereto to a temperature such that water does not condense from the combined stream. The heated combined stream exits the burner tube 36 by way of the openings or ports 42 therein and mixes with air from the tertiary plenum flowing past the burner 40 by way of the passages 20 in the firing wall 18. In a like manner, the atomized liquid from the liquid stream or streams conducted to the liquid burner guns 58 and distributed therefrom by the nozzles 62 is combined with air flowing past the nozzles 62 from the tertiary plenum. The resulting gas-air mixture and atomized liquid-air mixture are ignited by the burning fuel from the burner ring 66 and continuously combusted whereby the gases and liquid are incinerated and the heat and combustion products from the incineration are liberated within the furnace 30.

As will be understood, adjustable louvers or other conventional air flow controlling means can be substituted for the presized openings or slots in the baffle 84 and other air flow controlling means can be used in lieu of the adjustable louvers 86. Further, the back wall 14 can be, and preferably is, removable for providing access to the interior of the housing 12 and the louver or other air flow controlling means therein.

Because the dry gas and wet gas streams to be incinerated are combined and the combined stream is heated as it flows through the gas burner tube 36, condensation of water vapor contained in the wet gas and the formation of corrosive liquids which bring about the rapid corrosion of burner parts are prevented. In addition, the preheating of the combined gas stream brings about the more efficient ignition and combustion of the gases being incinerated.

In order to facilitate a clear understanding of the method and apparatus of the present invention, the following example is given.

EXAMPLE

The burner apparatus 10 is utilized to simultaneously incinerate liquid, dry gas and wet gas streams of chlorinated hydrocarbons from the vents of a vinyl chloride production facility. 13,143 scf per hour of fuel gas is distributed through the burner ring 66 of the apparatus 10 and combusted to give a heat release of about 12,000,000 BTU's per hour. The fuel gas is at a pressure of 10 psig and has a specific gravity of 0.57.

A stream of dry chlorinated hydrocarbons from the product loading rack and other vents in the vinyl chloride production facility is combined with a wet gas stream of chlorinated hydrocarbons from the tank farms and wet vents in the facility at a combined stream pressure of 12 inches water column. The combined stream is heated while flowing through the gas burner tube 36 of the apparatus 10 to a temperature such that water is prevented from condensing in the burner apparatus and ignited and combusted to produce a total heat release of about 46,500,000 BTU's per hour.

The liquid stream of chlorinated hydrocarbons is proportioned between the three liquid burner guns 58 of the burner apparatus 10. The total liquid flow rate to the three burner guns is in the range of from 400 to 408 pounds per hour at a pressure in the range of from about 10 to about 100 psig.

A side stream of the fuel gas described above is utilized as pilot gas at a pressure of from about 7 to about 10 psig whereby the pilot heat release is about 350,000 BTU's per hour.

The burner apparatus 10 in the above-described service for incinerating liquid, dry gas and wet gas streams of chlorinated hydrocarbons operates much more efficiently and with less maintenance than a similar burner which burns the wet and dry gas streams in separate burner nozzles and does not include means for heating either gas stream.

Thus, the present invention is well adapted to carry out the object and attain the ends and advantages mentioned as well as those inherent therein. While numerous changes in the construction and arrangement of parts can be made by those skilled in the art, such changes are encompassed within the spirit of this invention as defined by the appended claims.

The embodiments of the invention in which an exclusive property or privilege is claimed are defined as follows:

1. An improved burner apparatus for simultaneously incinerating liquid, dry gas and wet gas streams comprising:

a housing having a forward firing wall, a back wall spaced rearwardly from said forward firing wall, and a side wall extending forwardly to said firing wall and rearwardly to said back wall and forming an enclosed plenum chamber, said housing further including a first baffle having a forward end attached to said firing wall and having a rearward end adjacent said back wall, said first baffle being disposed within said side wall so that a primary air plenum is defined by and between said first baffle and said side wall of said housing, there being an air inlet into said primary air plenum; and a perforated second baffle having a forward end attached to said firing wall and having a rearward end attached to said back wall, said second baffle being disposed within said first baffle so that a secondary plenum is defined by and between said first baffle and said second baffle and so that a tertiary plenum is defined by and within said second baffle; and said firing wall including a plurality of air passages in communication with said secondary and tertiary plenums but not with said primary plenum so that air flows through said air passages only from said secondary and tertiary plenums;

a centrally positioned elongated gas burner tube sealingly connected through said back wall, extending longitudinally through said housing within said tertiary plenum and through said firing wall, the rearward end of said gas burner tube having a wet gas and/or dry gas inlet connection attached thereto and the forward end of said tube terminating in a gas burner nozzle positioned adjacent said firing wall;

means for heating gas flowing through said gas burner tube and attached thereto;

at least one liquid burner tube positioned adjacent said gas burner tube within said tertiary plenum and further sealingly connected through said back wall, extending longitudinally through said housing and extending through said firing wall;

means for atomizing a liquid issuing from said liquid burner tube and distributing the atomized liquid produced, and further said liquid burner tube including a liquid stream inlet connection disposed in said liquid burner tube, whereby atomized liquid is distributed from a forward end of said liquid burner tube at a position adjacent said firing wall; and means for igniting and continuously combusting fuel gas attached to said firing wall and positioned adjacent said gas burner nozzle means and the forward end of said liquid burner tube.

2. The apparatus of claim 1 wherein said means for heating gas flowing through said gas burner tube comprises:

a jacket for conducting steam sealingly attached to the exterior of said gas burner tube; and steam inlet and outlet connections attached to said jacket.

3. The apparatus of claim 1 wherein said means for igniting and continuously combusting fuel gas comprises:

a fuel gas burner nozzle attached to said firing wall; and a conduit attached to said fuel gas burner nozzle extending through said housing and sealingly through said back wall thereof.

4. The apparatus of claim 3 wherein said fuel gas burner nozzle is a burner ring surrounding said gas burner nozzle and the forward end of said liquid burner tube.

5. The apparatus of claim 4 wherein said apparatus includes three liquid burner tubes the interior ends of which are positioned adjacent said firing wall within said burner ring, each having means for atomizing a liquid stream and distributing the atomized liquid produced disposed therein.

6. The apparatus of claim 5 wherein said housing is cylindrical.

7. The apparatus of claim 6 wherein said housing is adapted to be attached to a furnace at the firing wall end thereof.

* * * * *